United States Patent [19]

Iliff

[11] 4,150,865

[45] Apr. 24, 1979

[54] MAGNETO TO SPARK PLUG AIRCRAFT WIRING HARNESS

[76] Inventor: Charles E. Iliff, Hgr. 17, Intl. Airport, Tulsa, Okla. 74115

[21] Appl. No.: 816,370

[22] Filed: Jul. 18, 1977

[51] Int. Cl.[2] ..... H01R 13/52

[52] U.S. Cl. ..... 339/26; 339/27; 339/89 C

[58] Field of Search ..... 339/26, 27, 116 R, 116 C, 339/89 C

[56] References Cited

U.S. PATENT DOCUMENTS

| | | | |
|---|---|---|---|
| 2,149,137 | 2/1939 | Gardner | 339/26 X |
| 2,312,757 | 3/1943 | Frei | 339/89 C X |
| 2,372,490 | 3/1945 | Hartzell | 339/89 C |
| 2,571,774 | 10/1951 | Spengler et al. | 339/27 |

FOREIGN PATENT DOCUMENTS

| | | | |
|---|---|---|---|
| 684804 | 12/1952 | United Kingdom | 339/26 |

*Primary Examiner*—Roy Lake
*Assistant Examiner*—E. F. Desmond
*Attorney, Agent, or Firm*—Head, Johnson & Chafin

[57] ABSTRACT

An improved moisture proof harness lead assembly for use with a magneto distributor housing block having a plurality of threaded bores therein for connection to one end of said harness.

7 Claims, 4 Drawing Figures

MAGNETO TO SPARK PLUG AIRCRAFT WIRING HARNESS

BACKGROUND OF THE INVENTION

This invention relates generally to the electrical lead connection between the spark plugs and the magneto of an internal combustion engine, and in particular to said lead connection for use in the aviation industry. It is well known in the aircraft engine art that a tendency exists for moisture and dirt to interfere with the connection between the spark plug and harness lead or between the harness lead and magneto, thereby resulting in misfiring of the plug and corollary poor engine performance.

Moisture proofing of the terminal connections is hampered somewhat by the physical construction of the lead wires or cables. Said cables are normally made with a center conducting core such as copper, insulated, shielded, with a woven metal braid, and again covered with insulation. The shielding braid is necessary to prevent radio interference from the ignition system, and even minor twisting of the braid during installation permits spurious electromagnetic radiation to escape.

There have been numerous efforts by inventors in the field to provide moisture-proof terminal connections for the leads. Of note are the terminal means disclosed in U.S. Pat. No. 3,262,085, issued July 19, 1966 to F. S. Slick and in the U.S. Pat. No. 3,334,326, issued Aug. 1, 1967 to C. D. Besore, et al.

The Slick patent discloses the use of a resilient helical compression spring connected to the cable core as an improved contact terminal for connection to a magneto.

The Besore invention discloses a moisture-proof connector for aircraft spark plugs which have an externally threaded cylindrical barrel encasing the plug insulator and contact. The connector basically comprises an electrical cable covered with insulation and having contact means at one end thereof for engagement with the plug contact terminal. A tubular grommet of resilient material adapted to fit within the plug barrel is positioned on the cable end adjacent the contact means for providing a moisture-proof barrier when inserted in the cylindrical band. A rigid ferrule and nut are placed on the cable above the grommet for securing the cable to the barrel.

Present aircraft harness leads on the market are inserted through the magneto distributor housing, the shielding flared, and held in place with a ferrule inside the housing. This particular arrangement understandably creates considerable difficulties should replacement of the lead be required.

It is therefore an object of this invention to provide a new improved harness assembly and magneto block which are moisture-proof, facilitate the quick replacement of the harness lead, if necessary, and provide improved electrical connection without distortion of the shield wire.

SUMMARY OF THE INVENTION

The invention contemplates a novel moisture-proof harness lead assembly and magneto distributor housing block for use with aircraft internal combustion engines. Although the invention is designed for use as a total unit, the same is best described in terms of the harness plug connector, harness magneto connector, and magneto block. Any suitable and well-known shielded insulated cable common to the industry may be used to conduct current from the aircraft magneto to the engine's spark plug. As with all aircraft plugs, the plug includes an externally threaded metal cylindrical barrel encasing the plug insulator and contact. The harness plug connector includes a pair of complementary tapered ferrules mounted near one end of the cable for gripping the shield material therebetween. A threaded terminal is fastened to the center cable core and a contact nut having a central recess in the base thereof is threaded thereon so that the end of the terminal protrudes into said recess. A contact spring, threaded on the terminal end, locks the contact nut in place and provides electrical contact between the plug and harness. A tubular grommet interposed between the contact nut and the ferrules is held firmly in place by a helical compression spring bushing interposed between the ferrules and grommet. A cap having a central opening therethrough and an annular shoulder for engaging the outer ferrule is used to secure the cable to the cylindrical plug barrel.

The magneto end lead connector comprises a pair of complementary tapered ferrules mounted near the other end of said conductor for gripping the shielding material between the ferrules. The outer ferrule is provided with an annular shoulder having an outer diameter substantially equal to the inner bore diameter of the magneto block as hereinafter explained. A threaded terminal is fastened to the conductor end and a contact nut threaded on said terminal. A resilient tubular grommet having a passageway therethrough is interposed on the conductor between the contact nut and the pair of ferrules. Said grommet bears an external annular collar adjacent the ferrules with an outer diameter substantially equal to the diameter of the annular shoulder on the outer ferrule. A threaded male fitting having a central bore therethrough is rotatably mounted on the cable such that one end thereof abuts the annular shoulder of the outer ferrule when threaded into the magneto block, thereby providing a moisture-proof barrier.

A magneto distributor housing block is provided for attachment by any suitable means to the magneto distributor housing. Access to the distributor electrical contacts is provided by a plurality of threaded bores in alignment therewith. At the base of each bore an annular lip is provided for engagement with the annular shoulder of the tubular grommet affixed to the magneto harness lead.

DETAILED DESCRIPTION OF THE PREFERRED EMBODIMENT

Figure 1:
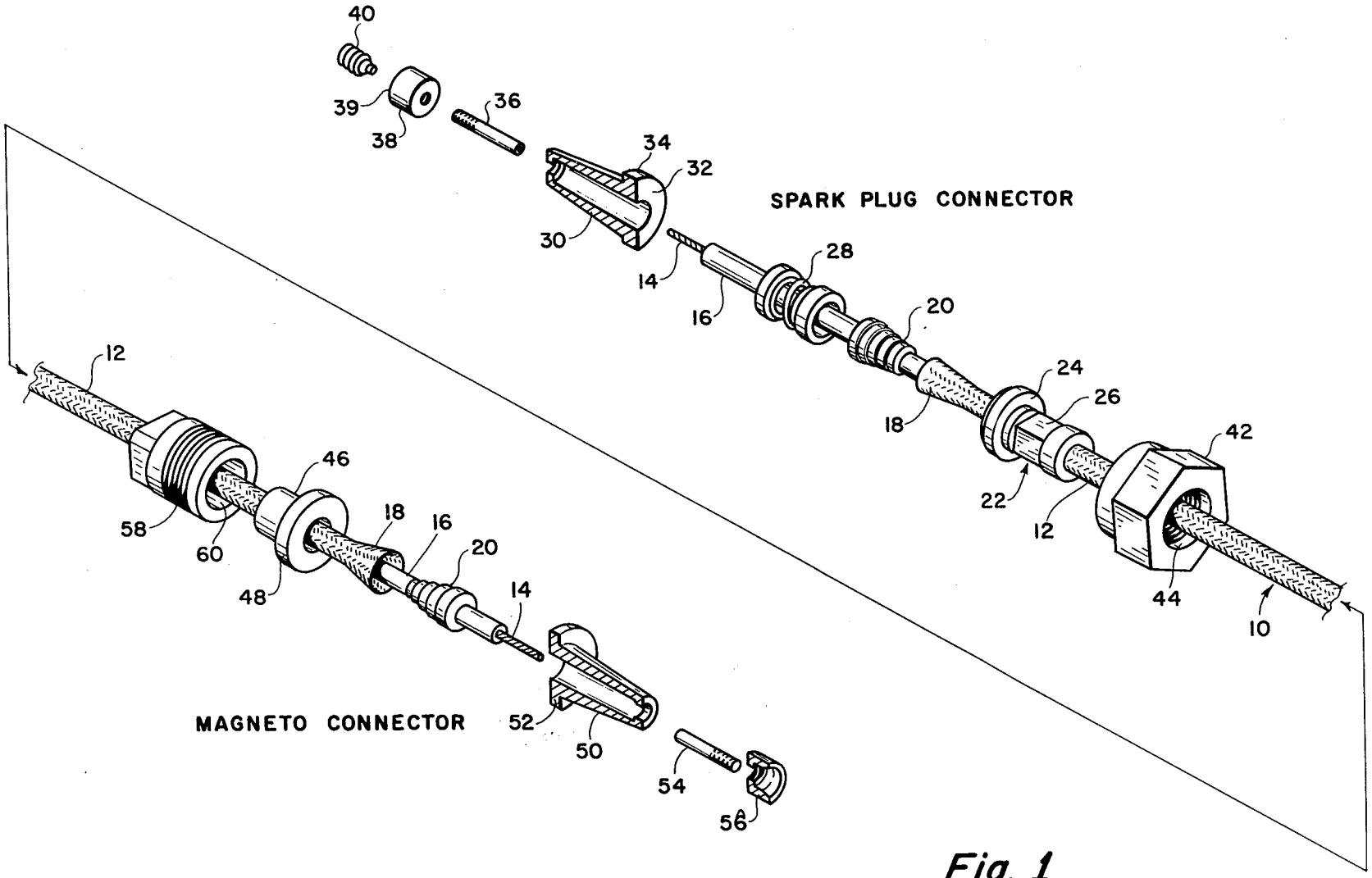
FIG. 1 is an exploded perspective view of a single harness lead.
Figure 2:
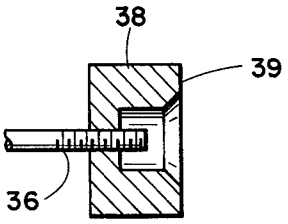
FIG. 2 is a view partly in cross-section of the contact nut and threaded terminal.

Referring to the drawings and in particular to FIG. 1 thereof, a subject harness lead is generally characterized by reference numeral 10. A cable 12 having a center conductor 14, electrical insulation 16 covering the center conductor, and an insulated shielding braid 18 is used for the transmission of electrical ignition current from the magneto (not shown) to an engine spark plug having a standard cylindrical metal barrel encasing the plug insulator and contact (not shown). At each end of the cable a portion of the shield braid is removed and the shielding braid ends flared for receiving a tapered inner ferrule 20. At the spark plug end of the lead, a plug end outer ferrule, having a bore complementary to the taper of the inner ferrule, generally characterized by reference numeral 22, is provided for press fitting the shielding braid between the ferrule members. The plug ferrule 22 has an annular shoulder 24 adjacent said shielding end and the exterior of plug ferrule 22 preferably presents a plurality of torqueing surfaces 26. A helical compression spring bushing 28 is positioned around insulation 16 in abutment with ferrules 20 and 22. Tubular grommet 30 constructed of a resilient insulating material, such as rubber, is also placed over the insulation 16 in series relation with bushing 28. An annular projection 32 from the grommet provides an outer peripheral wall surface 34 substantially equal to the inner diameter of the cylindrical plug barrel which serves as a moisture barrier. A threaded terminal 36 is crimped or otherwise securely fastened to the plug end of center conductor 14. Threaded on terminal 36 is a retaining contact nut 38. The contact nut when threaded into position abutting the end of grommet 30 compresses the grommet 30 firmly against spring bushing 28. Face 39 of contact nut 38, as more clearly shown in FIG. 2 is centrally recessed so that the end of threaded terminal 36 protrudes through the nut into said recess. A contact spring 40 comprised of a pair of different diameter coils is threaded on the end of terminal 36 in the recess interior, thereby locking the contact nut in place. Plug cap 42, having a central aperture therethrough, is placed on the lead cable and has an inner shoulder 44 for abutting shoulder 24 of outer ferrule 22. In operation, plug cap 42 is threaded to the spark plug cylindrical barrel and electrical contact with the plug is made via the contact spring and nut. Torqueing surfaces 26 of ferrule 22 may be restrained with a back-up wrench during threading to prevent twisting of the shield braid.

At the opposite end of the lead, a magneto outer ferrule having a bore complementary to the taper of the inner ferrule, characterized generally by reference numeral 46 is provided for press fitting the braid between the ferrule members. The magneto outer ferrule 46 has an annular shoulder 48 adjacent the shielding end. A tubular magneto grommet 50 constructed of a resilient insulating material, such as rubber, is placed over the end of insulation 16 in abutment with the ferrule shoulder. Grommet 50 is provided with an annular shoulder 52 substantially equal in outer diameter to the outer diameter of magneto ferrule shoulder 48. As with the spark plug end, a threaded terminal 54 is crimped or otherwise fastened to the end of center conductor 14 and a contact nut 56 is threaded thereon in abutment with the grommet. A threaded male fitting 58 having a bore therethrough of inner diameter substantially equal to the outer diameter of the magneto ferrule body 46 is placed on the cable adjacent said ferrule 46.

Figure 3:
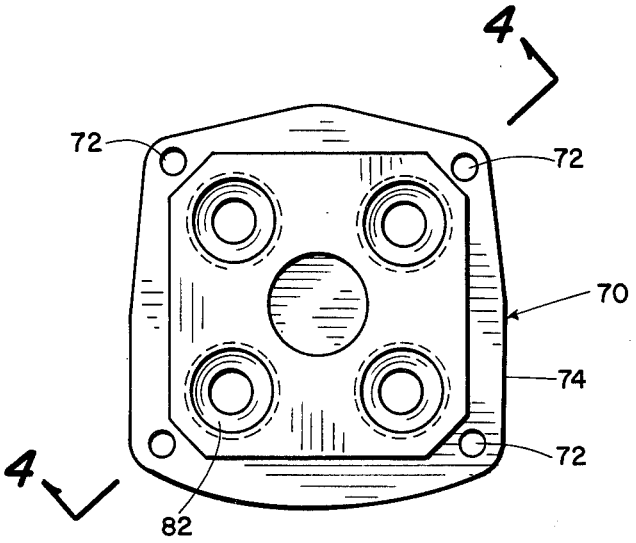
FIGS. 3 and 4 are elevational views of a magneto block for a four-cylinder engine.
Figure 4:
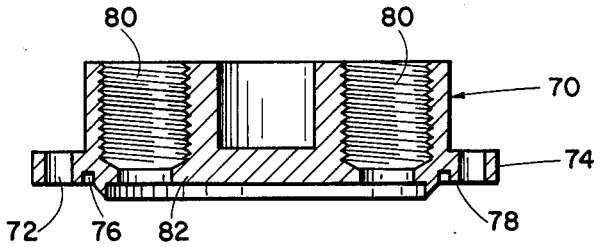

A magneto distributor housing block generally indicated by reference numeral 70 is shown in FIGS. 3 and 4 for attachment to the magneto housing. The particular block illustrated is suitable for a four-cylinder engine. Block 70 is attached to the magneto housing (not shown) by means of bolts passing through bores 72 drilled in flange 74. A circular groove 76 is prepared in mating surface 78 of the block to prevent moisture and dirt from entering the magneto housing. Threaded bores 80 complementary to the size of male fitting 58 are provided therein. The bore size is reduced in diameter near surface 78 to provide an annular lip 82 having an inner diameter substantially equal to the diameter of the outer magneto grommet body 50. In operation, the magneto end of the harness lead is inserted in bore 80 and male fitting 58 is firmly threaded in place. Through the threading action, ferrule annular shoulder 48 is pressed tightly against the rubber grommet shoulder 52 abutting lip 82, thereby providing a simple but effective moisture-proof seal. The bore placement is arranged such that the magneto ends of the harness leads protruding through the block are brought into electrical contact with distributor contacts.

Whereas the present invention has been described in particular relation to the drawings attached hereto, it should be understood that other and further modifications, apart from those shown or suggested herein, may be made within the spirit and scope of this invention. For example, because aircraft engines typically include a dual set of harness wiring, the leads 10 are color coded, e.g., one set red, the other yellow, to assist the mechanic in replacement.

What is claimed is:

1. A lead conductor for a spark plug having a threaded cylindrical barrel encasing the plug insulator and contact, the connector comprising;

(a) a shielded insulated conductor;

(b) inner and outer complementary tapered ferrules mounted near one end of said conductor, the reduced size end being oriented toward the conductor and away from the plug for gripping the end portion of the shielded material between said inner and outer ferrules;

(c) a threaded terminal fastened to the conductor end;

(d) a contact nut affixed to said threaded terminal;

(e) a contact spring threaded to the end of the threaded terminal;

(f) a tubular grommet of flexible insulative material having a passageway therethrough interposed on said conductor between the contact nut and the ferrules, the end of the grommet in contact with said ferrules having a flared shoulder; and (g) a cap means for securing the outer ferrule to the cylindrical barrel.

2. A lead connector, as recited in claim 1 wherein the contact nut having a central recess in the face thereof threaded to the terminal so that the end of said terminal protrudes within the recess.

3. A lead connector for a spark plug having a threaded cylindrical barrel encasing the plug insulator and contact which comprises:

a shielded insulated conductor;

a pair of complementary tapered ferrules mounted near one end of said conductor gripping the shielded material between said ferrules;

a threaded terminal and associated contact nut fastened to the conductor end;

a contact spring threaded to the end of the terminal;

a tubular grommet having a passageway therethrough interposed from said conductor between the contact nut and the pair of ferrules;

a helical compression spring bushing interposed between said ferrules and the tubular grommet; and cap means for securing the outer ferrule to the cylindrical barrel.

4. A lead connector, as recited in claim 3 wherein the contact nut having a central recess in the face thereof threaded to the terminal so that the end of said terminal protrudes within the recess.

5. A lead connector, as recited in claim 4, wherein said outer ferrule has torqueing surfaces for restraining said ferrule from twisting whenever the ferrule is secured to the cylindrical barrel.

6. A lead connector for a magneto block having a plurality of threaded bores and having an annular shoulder at the base of each bore, which comprises:

a shielded insulated conductor;

a pair of complementary tapered ferrules mounted near one end of said conductor for gripping the shielding material between said ferrules, the outer ferrule having an annular shoulder with an outer diameter substantially equal to the inner magneto block bore diameter;

a threaded terminal fastened to the conductor end;

a contact nut threaded to the terminal;

a tubular grommet having a passageway therethrough interposed on said conductor between the contact nut and the pair of ferrules;

an external annular collar on the end of said grommet adjacent said ferrules having an outer diameter substantially equal to the inner magneto block bore diameter; and a threaded male fitting having a central bore therethrough rotatably mounted on the cable such that one end thereof abuts the annular shoulder of the outer ferrule, said fitting being sized for threading into the magneto block.

7. The connector of claim 6 wherein said magneto block includes means for securing said plate to a magneto housing such that the bores are in alignment with megneto distributor contacts therein and wherein the facing surface of said plate has a circular groove therein extending around the bases of said threaded bores for receiving an O-ring.

* * * * *